US011571074B1

(12) United States Patent
Hilton et al.

(10) Patent No.: US 11,571,074 B1
(45) Date of Patent: Feb. 7, 2023

(54) BEDDING DEVICE FOR HANDLING THE BEDDING OF A BED

(71) Applicants: Jason Hilton, Keizer, OR (US); Tina Hilton, Keizer, OR (US)

(72) Inventors: Jason Hilton, Keizer, OR (US); Tina Hilton, Keizer, OR (US)

( * ) Notice: Subject to any disclaimer, the term of this patent is extended or adjusted under 35 U.S.C. 154(b) by 110 days.

(21) Appl. No.: 17/109,695

(22) Filed: Dec. 2, 2020

(51) Int. Cl.
*A47C 21/02* (2006.01)
*A61G 7/05* (2006.01)

(52) U.S. Cl.
CPC ..... *A47C 21/028* (2013.01); *A47C 21/022* (2013.01); *A61G 7/0501* (2013.01)

(58) Field of Classification Search
CPC .... A47C 21/022; A47C 21/028; A61G 7/0501
See application file for complete search history.

(56) References Cited

U.S. PATENT DOCUMENTS 4,441,222 A * 4/1984 Tascarella ..... A47C 21/028 5/488
8,250,688 B2 8/2012 Alegria Mendez
2002/0170114 A1* 11/2002 Wolcott ..... A61G 7/0501 5/488

FOREIGN PATENT DOCUMENTS

ES 2858677 * 9/2015 ..... A47C 29/006

* cited by examiner

*Primary Examiner* — David R Hare
*Assistant Examiner* — Madison Emanski
(74) *Attorney, Agent, or Firm* — Sanchelima & Associates, P.A.; Christian Sanchelima; Jesus Sanchelima

(57) ABSTRACT

Bedding device unfolds and straightens bedding on a bed and which is simple in construction, easy to operate by physically weak users, sturdy during operation and angularly adjustable. Bedding device includes an actuator unit, a pair of immovable supports, horizontal adjusters, vertical adjusters, angle adjusters, bedding handlers and a plurality of clamps. Actuator unit is positioned at the base of bed and is connected with an actuating switch positioned nearby the user to be operable by hands or legs. Immovable supports enable sturdy operations. Horizontal adjusters and vertical adjusters adjust bedding handlers in accordance with the size of bed. Angle adjusters angularly adjust bedding handlers so that bedding handlers are in-line with the mattress in an inclined configuration. Bedding handlers have clamps that hold bedding and when actuated by user through actuating unit, bedding handlers unfolds and straightens bedding on mattress of bed.

10 Claims, 8 Drawing Sheets

BEDDING DEVICE FOR HANDLING THE BEDDING OF A BED

II. BACKGROUND OF THE INVENTION

1. Field of the Invention

The present disclosure relates to a bedding device for handling the bedding of a bed. More particularly, the present disclosure relates to a bedding device for unfolding and straightening bedding such as a comforter, a quilt, a duvet or a bedspread on a bed.

2. Description of the Related Art

Making a bed by unfolding and straightening bedding on bed is a monotonous task which is to be performed every day. Unfolding and straightening bedding is a challenging task owing to less physical strength for disabled persons, elders or children. Hence, there is a need for a bedding device that unfolds and straightens bedding such as a comforter, a quilt, a duvet or a bedspread on a bed to make a bed.

Several designs for various bed making apparatus and systems have been designed in the past. None of them, however, includes a bed making device comprising a central hub with telescopic securing pegs, and extendable moving bed making arms. The bedding device is simple in construction, easy to operate from any location, angularly adjustable, and sturdy during operation.

Applicant believes that a related reference corresponds to a U.S. Pat. No. 8,250,688 filed by Jose Luis Alegria Mendez, Michelle Carla Danzinger Canata, Edson Concha Quechuyao for a bedding straightening mechanism. The patent '688 discloses a device that enables the function of automatically unfolding and straightening bed clothing. However, as a number of components are positioned under bed, the mechanism is complex and the components are difficult to access during maintenance.

Another related application is U.S. Pat. No. 4,441,222 by Peter J. Tascarella for an automatic bed maker. The patent '222 discloses a bed making apparatus which is permanently attached to the frame of the bed and which folds down out of the way when not performing the bedmaking function. However, the apparatus requires helical screw action for bed making which involves a complex mechanism.

Other documents describing the closest subject matter provide for a number of more or less complicated features that fail to solve the problem in an efficient and economical way. None of these patents suggest the novel features of the present invention.

III. SUMMARY OF THE INVENTION

It is an object of the present invention to provide a bedding device that unfolds and straightens bedding on a bed and is simple in construction, easy to operate by physically weak users.

It is another object of the present invention to provide a bedding device that includes immovable supports positionable under bed to provide sturdiness to bedding device in an operative configuration.

It is still another object of the present invention to provide a bedding device that includes horizontal adjusters and vertical adjusters to adjust bedding handlers according to the size of bed.

It is yet another object of the present invention to provide an angle adjuster that angularly adjusts bedding handlers according to the inclination of bed.

Further objects of the invention will be brought out in the following part of the specification, wherein detailed description is for the purpose of fully disclosing the invention without placing any limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents a perspective view of a bedding device 10 for handling the bedding 11 on the mattress 12 disposed on a bed 13. The bedding device 10 includes an actuator unit 20, a pair of immovable supports 30, a pair of horizontal adjusters 40, a pair of vertical adjusters 50, a pair of angle adjusters 60, a pair of bedding handlers 70 and a plurality of clamps 80. Bedding handlers 70 are in an extended configuration.

Figure 1:
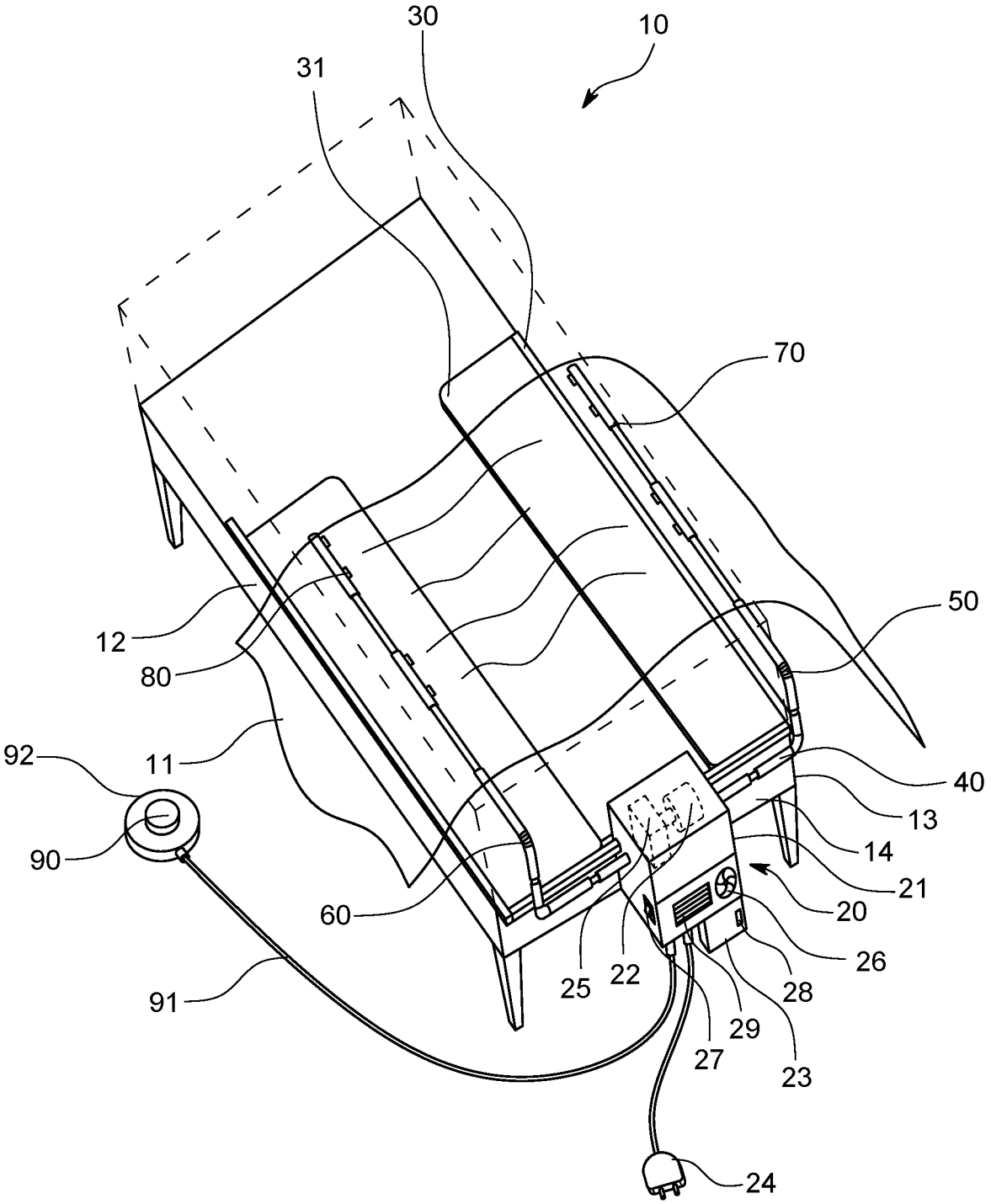
Figure 2:
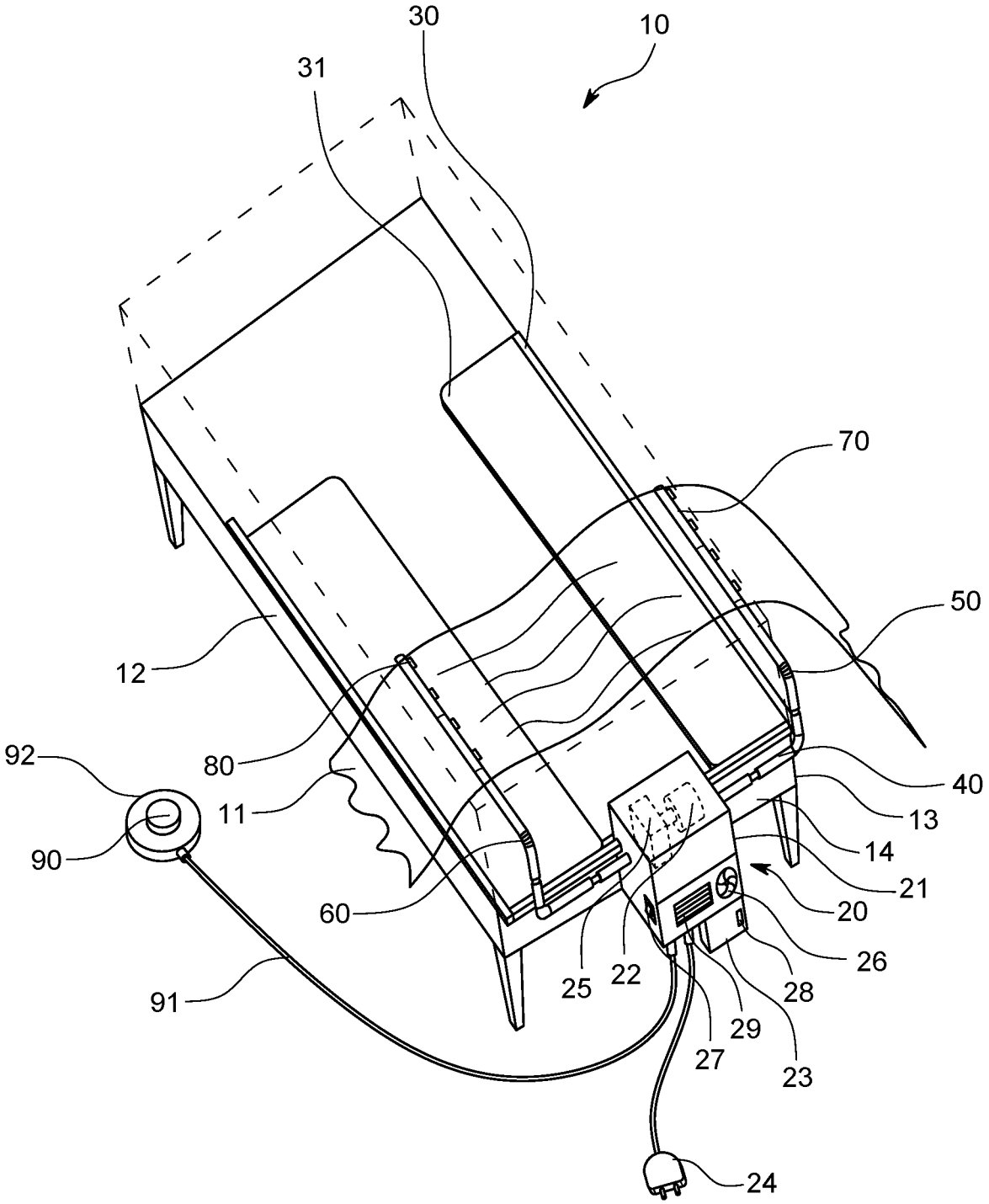
FIG. 2 represents another perspective view of bedding device 10 in which bedding handlers 70 are approaching towards retracted configuration.
Figure 3:
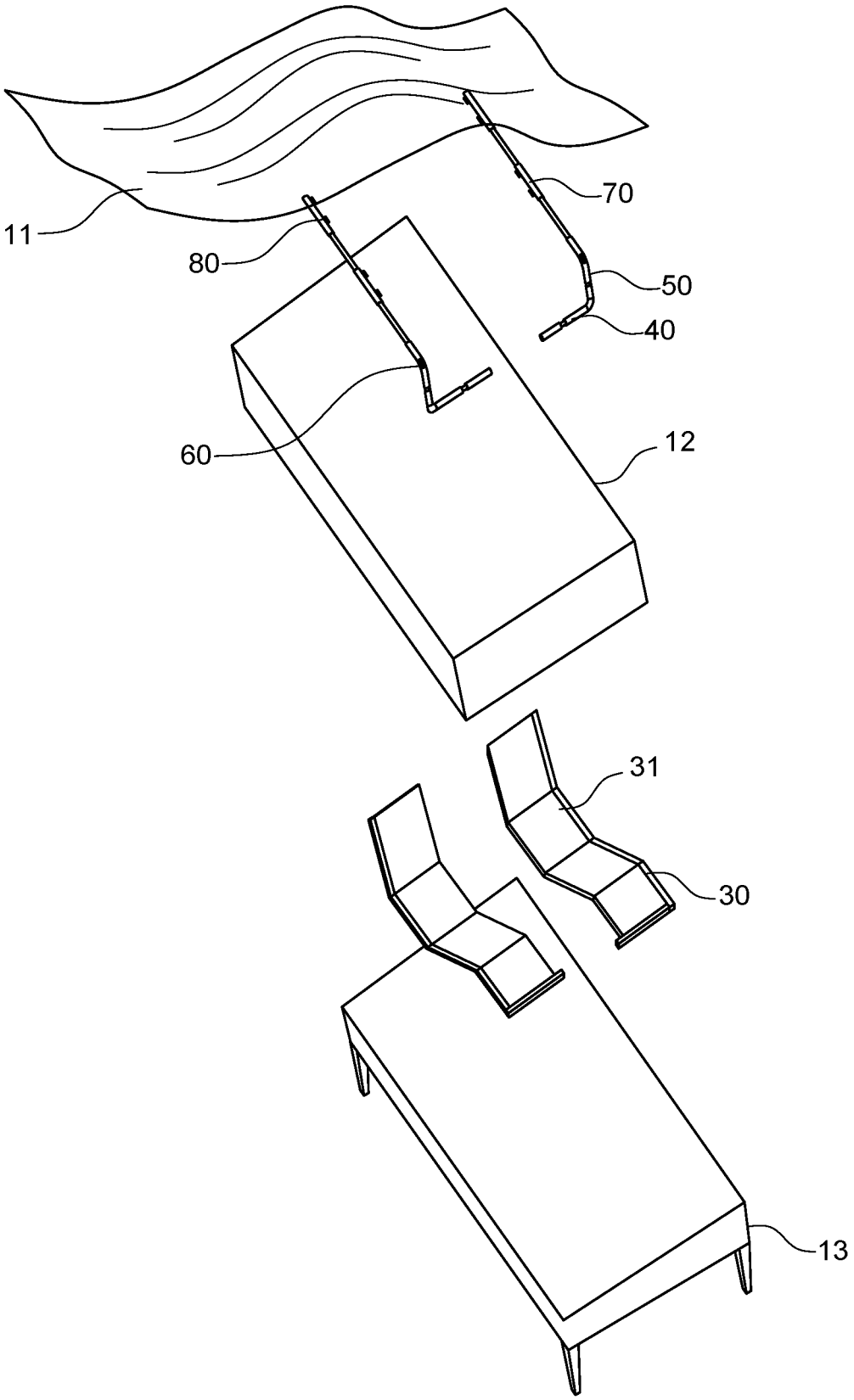
FIG. 3 represents an exploded view of bedding device 10.
Figure 4:
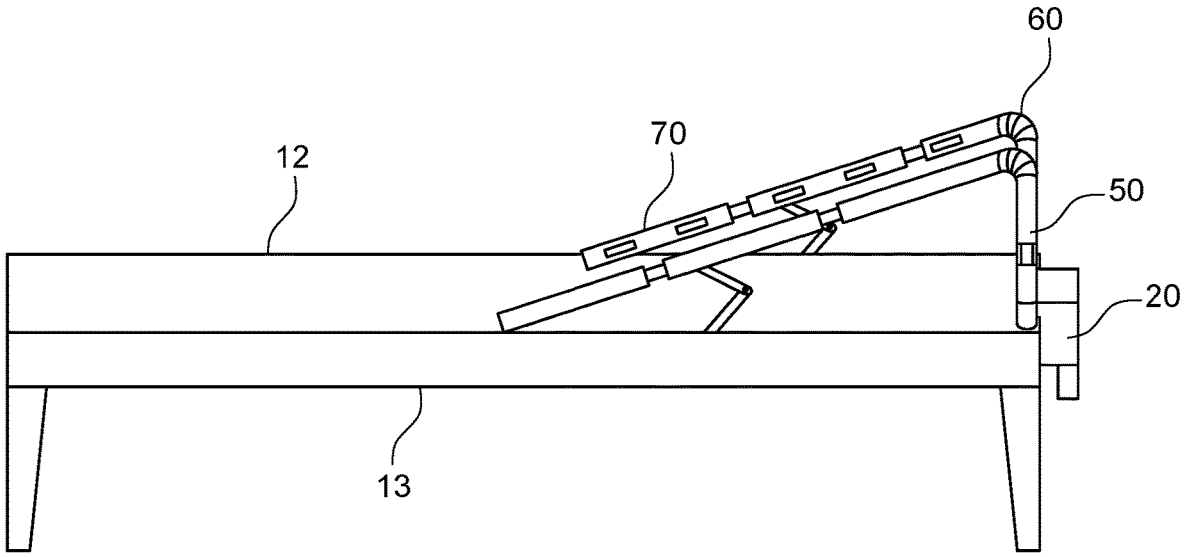

FIG. 4 represents a schematic side view of mattress 12 in a lifted configuration and bedding handlers 70 also tilted to be in-line with mattress 12.

Figure 5A:
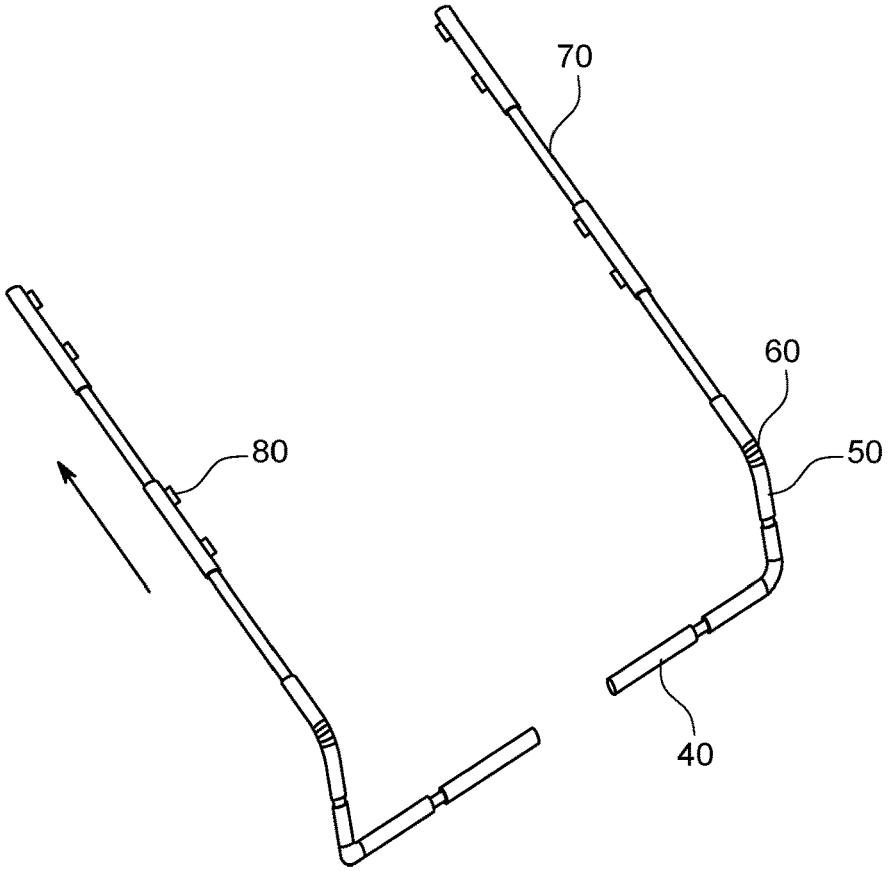

FIG. 5A represents a perspective view of bedding handlers 70 in an extended straight configuration.

Figure 5B:
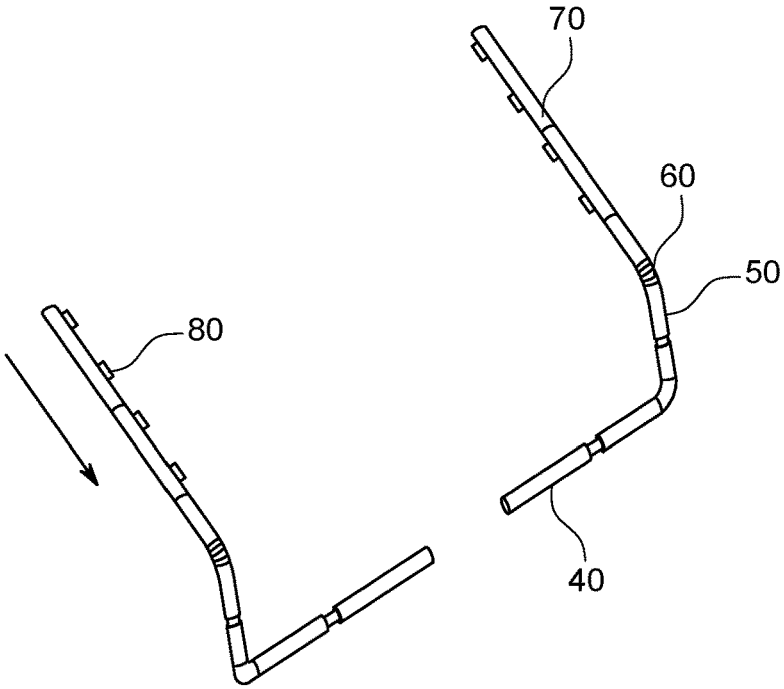

FIG. 5B represents a perspective view of bedding handlers 70 in a retracted straight configuration.

Figure 6A:
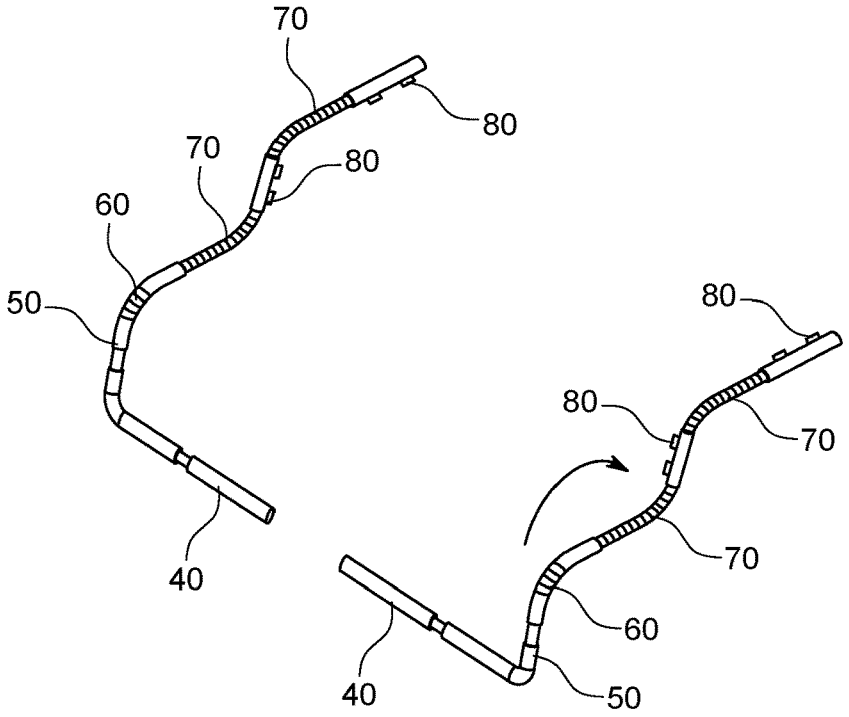

FIG. 6A represents a perspective view of bedding handlers 70 in a downward inclined configuration.

Figure 6B:
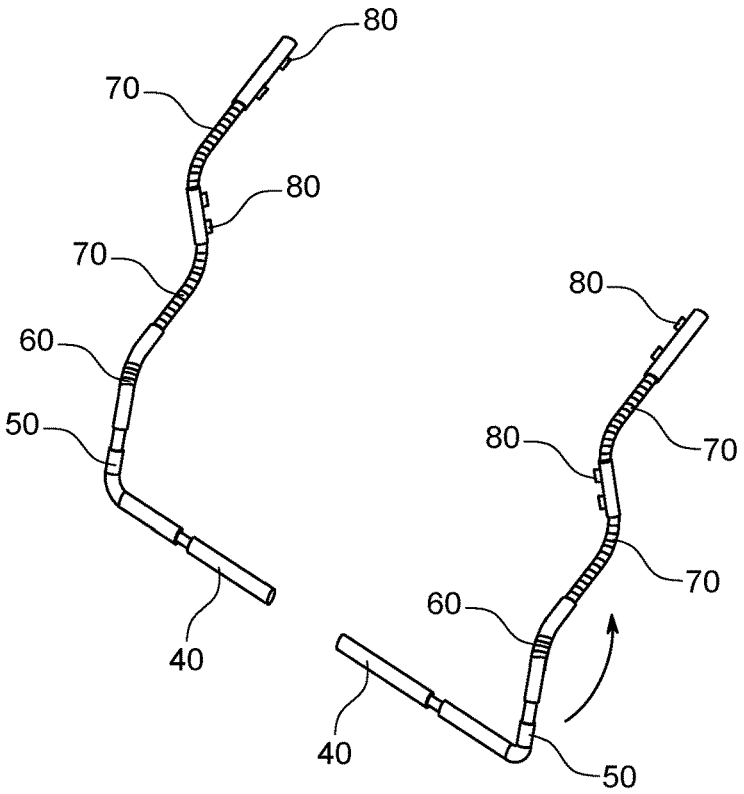

FIG. 6B represents a perspective view of bedding handlers 70 in an upward inclined configuration.

Figure 7A:
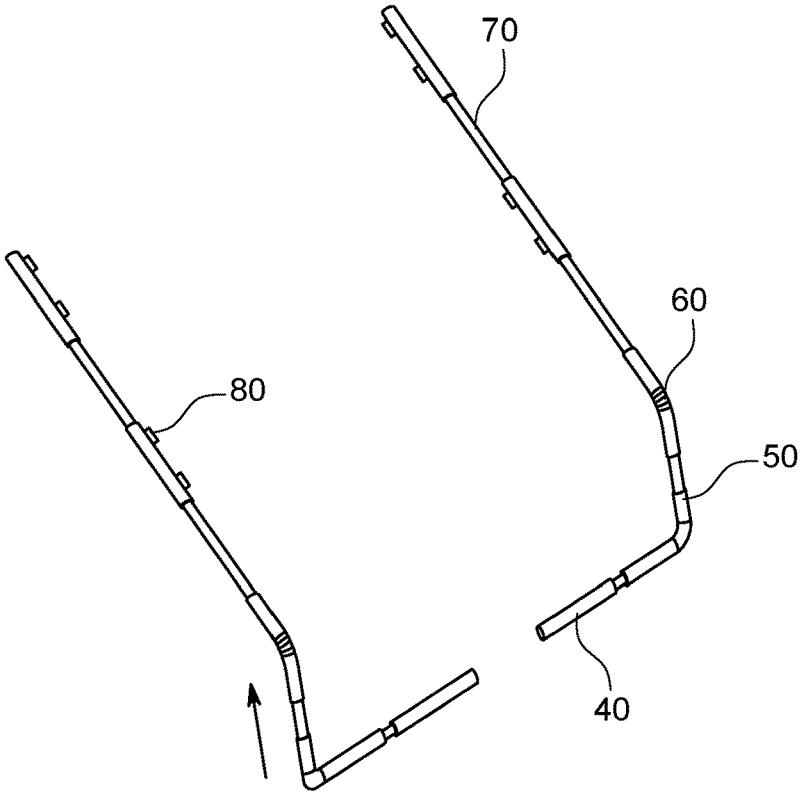

FIG. 7A represents a perspective view of vertical adjusters 50 in an extended configuration.

Figure 7B:
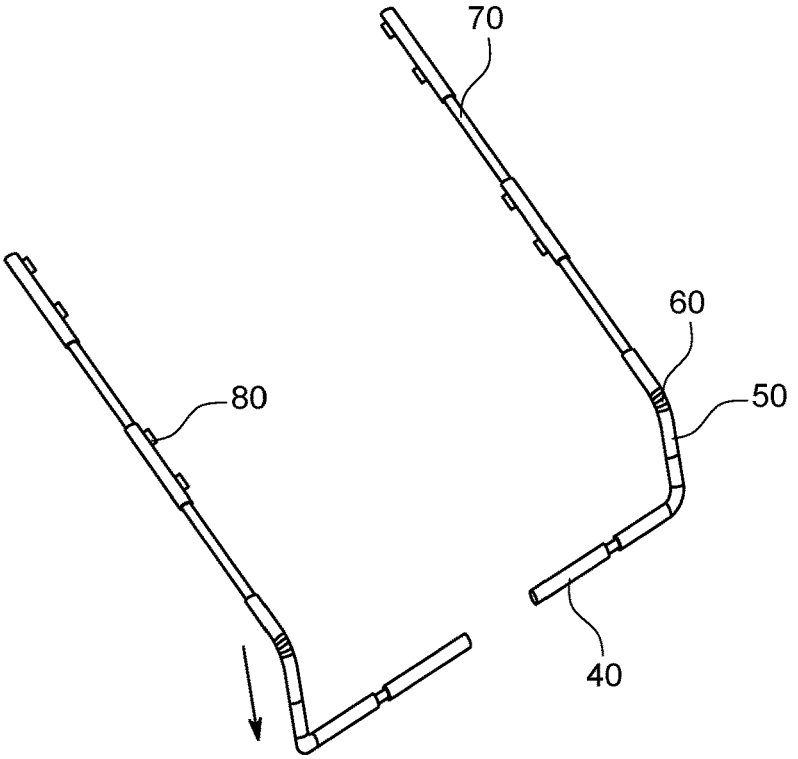

FIG. 7B represents a perspective view of vertical adjusters 50 in a retracted configuration.

Figure 8A:
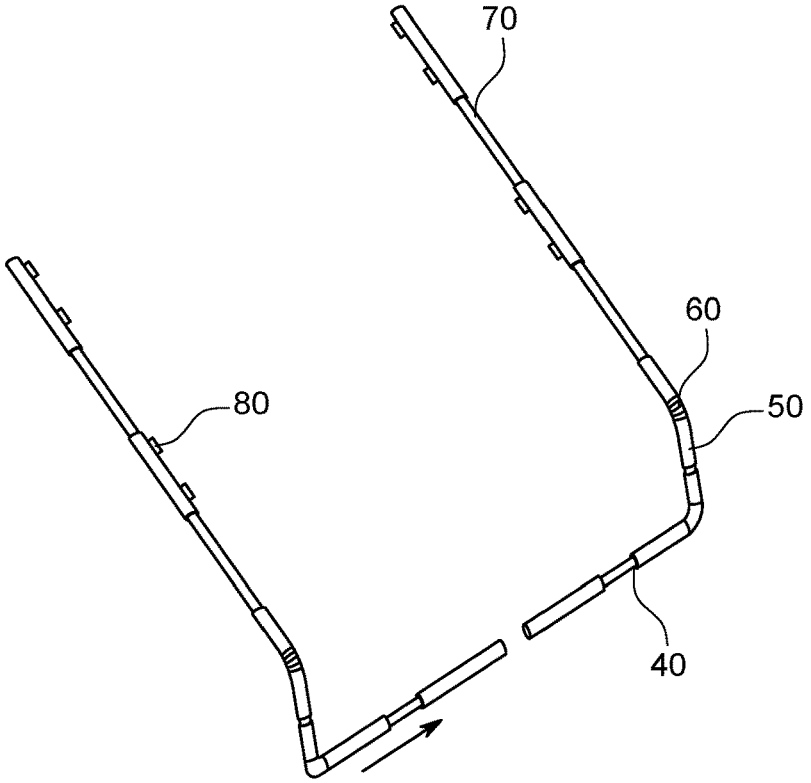

FIG. 8A represents a perspective view of horizontal adjusters 40 in an extended configuration.

Figure 8B:
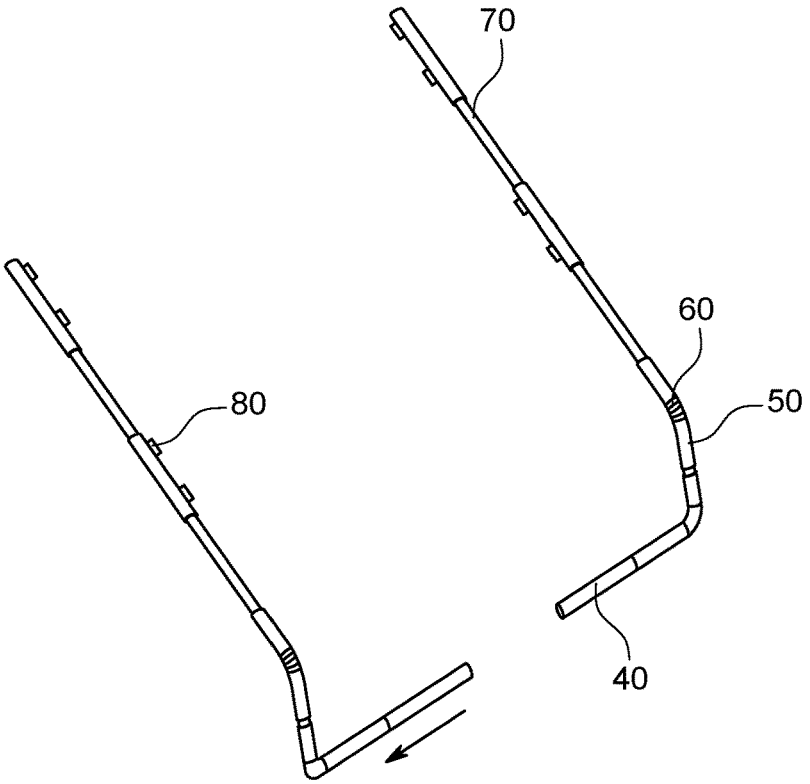

FIG. 8B represents a perspective view of horizontal adjusters 40 in a retracted configuration.

V. DETAILED DESCRIPTION OF THE EMBODIMENTS OF THE INVENTION

Referring now to the drawings, FIGS. 1-8B, where the present invention is generally referred to with numeral 10, it can be observed that a bedding device, in accordance with one embodiment, is provided for handling the bedding 11 on a mattress 12 positioned on a bed 13 that mainly includes an actuator unit 20, a pair of immovable supports 30, a pair of horizontal adjusters 40, a pair of vertical adjusters 50, a pair of angle adjusters 60, a pair of bedding handlers 70 and a plurality of clamps 80.

In an illustrated embodiment, actuator unit 20 is fitted at the base 14 of bed 13. However, the present disclosure is not limited to the fitting of actuator unit 20 at the base 14 of bed 13 and actuator unit 20 is positioned at any other location such as other portions of bed or positioned on the ground or a table in the vicinity of bed 13. Actuator unit 20 includes a casing 21, an electric motor 22, a power source 23, a power cord 24 and an actuating mechanism 25. Casing 21 is fitted on the base 14 of bed 13 or in the vicinity of bed 13 and houses the different components of actuator unit 20 as mentioned above. Further, the casing 21 can include a cooling fan 26, a safety switch 27 and a power indicator 28. Casing 21 is also configured with a vent 29 to allow dissipation of the heat of electric motor 22. Electric motor 22 activates and deactivates actuating mechanism 25. In one embodiment, power source 23 is a rechargeable power battery that can be either removed from casing 21 or can be permanently fitted in casing 21. Power cord 24 is a cord provided for charging the power source 23. Actuating mechanism 25 is actuated by electric motor 22 to enable extension or retraction of bedding handlers 70. In one embodiment, actuating mechanism 25 is actuated by electric motor 22 to enable extension or retraction of at least one of horizontal adjusters 40, vertical adjusters 50 and angle adjusters 60. Actuating mechanism 25 can be a mechanical mechanism, a pneumatic mechanism or a hydraulic mechanism. Cooling fan 26 is used to cool electric motor 22. Safety switch 27 deactivates electric motor 22 in event of overheating of electric motor 22. Power indicator 28 indicates the remaining power of power source 23.

Pair of immovable supports 30 extending from actuator unit 20 from either side. Each of immovable supports is provided with a projection 31. Projections 31 are inserted under mattress 12 such that projections 31 are sandwiched between mattress 12 and bed 13. Immovable supports 30 are provided to prevent undesired movement of all components of bedding device 10 in an operative configuration or an in-operative configuration.

Pair of horizontal adjusters 40 extends horizontally from actuator unit 20. Pair of horizontal adjusters 40 is extendable and retractable. Pair of horizontal adjusters 40 is adjusted by extending or retracting so that length of pair of horizontal adjusters 40 is approximately equal to cover the width of bed 13.

Pair of vertical adjusters 50 extends vertically from horizontal adjusters 40. Pair of vertical adjusters 50 is extendable and retractable. Pair of vertical adjusters 50 is adjusted by extending or retracting so that length of pair of vertical adjusters 50 projects beyond the height of mattress 12.

Angle adjusters 60 are disposed between vertical adjusters 50 and bedding handlers 70. Angle adjusters 60 are provided to adjust the angle of bedding handlers 70 so that bedding handlers 70 are in-line with mattress 12 of bed 13. In event when mattress 12 is lifted, bedding handlers 70 are tilted to be in-line with bedding handlers 70. Tilting can be upward tilting or downward tilting.

Bedding handlers 70 extends from angle adjusters 60 and are traverse with respect to vertical adjusters 60. Bedding handlers 70 extends and retracts up to a portion of the length of the mattress 12. In one embodiment, the portion is the mid-length of bed 13 so that when a user gets out of bed 13, the user is not likely to be injured because of bedding handlers 70.

Plurality of clamps 80 is provided at predetermined distances on bedding handlers 70. Clamps 80 hold longitudinal edges of bedding so that bedding can make bed 13 when bedding handlers 70 are extended. Clamps 80 can be magnets, pins, clips or hooks.

A power actuating switch 90 is provided that is connected to activate and deactivate power source 23 to further activate and deactivate electric motor 22. Power actuating switch 90 can be positioned anywhere in the vicinity of bed 13 and can be operable by a hand or a leg of a user. Power actuating switch 90 can be positioned on a side table or on the ground and is provided with an elongated cable 91. Power actuating switch 90 is assembled with a lighting device 92 so that power actuating switch 90 is easily locatable in dark conditions.

Immovable supports 30 are fitted at the time of installing of bedding device 10 with bed 13. Horizontal adjusters 40 and vertical adjusters 50 are also adjusted at the time of installation. Angle adjuster 60 is adjustable when the position of the mattress 12 is changed from inclined to flat or vice-versa. Bedding handles 70 are extended and retracted each time while making or unmaking bed 13.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bedding device for handling the bedding on a mattress of a bed, said bedding device comprising: an actuator unit provided with a power actuating switch, said actuator unit is disposed centrally at a base of said bed; a pair of immovable supports extended from said actuator unit, each immovable support defined with at least one projection sandwiched between the mattress and the bed, each immovable support extends parallel to each other and orthogonally with respect to the base of said bed that receives the actuator unit; a pair of horizontal adjusters extending horizontally and directly connected from lateral sides of said actuator unit configured to extend and retract up to the width of the bed; a pair of vertical adjusters extending vertically from said horizontal adjusters configured to extend and retract beyond the height of the mattress; a pair of angle adjusters connected to said vertical adjusters at distal ends opposite to said pair of horizontal adjusters; a pair of bedding handlers extending from said angle adjusters and traverse to said pair of vertical adjusters configured to extend and retract up to a portion of the length of the mattress, said angle adjusters configured to angularly adjust said bedding handlers to be in-line with the position of the mattress; and a plurality of clamps disposed at predetermined distances on said bedding handlers, said clamps configured to hold longitudinal edges of bedding for handling bedding.

2. The bedding device as claimed in claim 1, wherein said actuator unit comprises a casing, an electric motor disposed in said casing, a power cord selectively connected to a power source for selectively powering said power source, said power source configured to power said electric motor and an actuating mechanism operable by said electric motor, said actuating mechanism, by means of said motor, enables extension or retraction of at least one of said pair of horizontal adjusters, of at least one of said pair of vertical adjusters and at least one of said pair of angle adjusters.

3. The bedding device as claimed in claim 2, wherein said actuator unit further includes a vent configured on said casing, a cooling fan for cooling said electric motor, a safety switch for said electric motor and a power indicator for said power source.

4. The bedding device as claimed in claim 2, wherein said power source is a rechargeable power battery that is removably or permanently fitted in said casing.

5. The bedding device as claimed in claim 1, wherein said power actuating switch is movable by providing an elongated power cord projecting out from said actuator unit.

6. The bedding device as claimed in claim 1, wherein said power actuating switch is assembled with a lighting device.

7. The bedding device as claimed in claim 1, wherein said clamps are magnets, pins, clips or hooks.

8. A bedding device for handling the bedding on a mattress of a bed, said bedding device comprising: an actuator unit provided with a power actuating switch being movable by providing an elongated power cord projecting out from said actuator unit, said actuator unit is disposed centrally at a base of said bed, said power actuating switch assemble with a lighting device, said actuator unit defined by a casing configured with a vent, an electric motor disposed in said casing, a power cord selectively connected to a power source for selectively powering said power source, said power source configured to power said electric motor, an actuating mechanism operable by said electric motor, a cooling fan for said electric motor, a safety switch for said electric motor and a power indicator for said power source, wherein, said power source is a rechargeable power battery that is removably or permanently fitted with said casing; a pair of immovable supports extended from said actuator unit, each immovable support defined with at least one projection to be inserted under the mattress positioned on the bed; a pair of horizontal adjusters extending horizontally and directly connected to said actuator unit configured to extend and retract up to the width of the bed; a pair of vertical adjusters extending vertically from said horizontal adjusters configured to extend and retract beyond the height of the mattress; a pair of angle adjusters connected to said vertical adjusters; a pair of bedding handlers extending from said angle adjusters and traverse to said vertical adjusters configured to extend and retract up to a portion of the length of the mattress, said angle adjusters configured to angularly adjust said bedding handlers to be in-line with the position of the mattress; and a plurality of clamps disposed at predetermined distances on said bedding handlers, said clamps configured to hold longitudinal edges of the bedding for handling bedding, wherein said clamps are magnets, pins, clips or hooks.

9. A bedding device for handling the bedding on a mattress of a bed, said bedding device consisting of: an actuator unit provided with a power actuating switch being movable by providing an elongated power cord projecting out from said actuator unit, said power actuating switch assemble with a lighting device, said actuator unit defined by a casing configured with a vent, an electric motor disposed in said casing, a power cord selectively connected to a power source for selectively powering said power source, said power source configured to power said electric motor, an actuating mechanism operable by said electric motor, said actuating mechanism, by means of said motor, enables extension or retraction of at least one of said pair of horizontal adjusters, of at least one of said pair of vertical adjusters and at least one of said pair of angle adjusters, a cooling fan for said electric motor, a safety switch for said electric motor and a power indicator for said power source, wherein, said power source is a rechargeable power battery that is removably or permanently fitted with said casing; a pair of immovable supports extended from said actuator unit, each immovable support defined with at least one projection to be inserted under the mattress positioned on the bed; a pair of horizontal adjusters extending horizontally and directly connected to said actuator unit configured to extend and retract up to the width of the bed; a pair of vertical adjusters extending vertically from said horizontal adjusters configured to extend and retract beyond the height of the mattress; a pair of angle adjusters connected to said vertical adjusters; a pair of bedding handlers extending from said angle adjusters and traverse to said vertical adjusters configured to extend and retract up to a portion of the length of the mattress, said angle adjusters configured to angularly adjust said bedding handlers to be in-line with the position of the mattress; and a plurality of clamps disposed at predetermined distances on said bedding handlers, said clamps configured to hold longitudinal edges of the bedding for handling bedding.

10. The bedding device as claimed in claim 9, wherein said clamps are magnets, pins, clips or hooks.

* * * * *